United States Patent [19]

Bell

[11] Patent Number: 4,516,682

[45] Date of Patent: May 14, 1985

[54] MERCHANDISE DISPLAY RACK

[75] Inventor: Ted A. Bell, Coshocton, Ohio

[73] Assignee: Pretty Products, Inc., Coshocton, Ohio

[21] Appl. No.: 488,775

[22] Filed: Apr. 26, 1983

[51] Int. Cl.[3] ..... A47F 5/01

[52] U.S. Cl. ..... 211/59.1; 211/106; 248/221.1

[58] Field of Search ..... 211/106, 57.1, 59.1, 211/60 T, 181, 87, 32, 54.1; 248/175, 220.3, 220.4, 221.1, 221.2

[56] References Cited

U.S. PATENT DOCUMENTS

| | | | |
|---|---|---|---|
| 1,293,953 | 2/1919 | Shoemaker | 211/106 X |
| 1,710,711 | 4/1929 | Patterson | 211/87 X |
| 2,796,994 | 6/1957 | Saltners | 211/181 X |
| 3,973,678 | 8/1976 | Nesbitt | 211/181 X |
| 4,027,799 | 6/1977 | Stucker | 211/106 X |
| 4,303,163 | 12/1981 | Henry | 211/181 X |

*Primary Examiner*—Robert W. Gibson, Jr.
*Attorney, Agent, or Firm*—Robert E. Stebens

[57] ABSTRACT

A merchandise display rack is provided having a plurality of support brackets arranged in vertically displaced relationship to each other bracket to support groups of articles of merchandise in a plurality of vertically spaced tiers. The rack includes a support standard incorporating devices to facilitate fastening of the rack to a vertical support surface and the brackets are secured to an inclined support element in a reverse waterfall arrangement to suspend groups of articles partially below and rearwardly of a next above and forward group of articles to result in full exposure of the bottom portions of each of the groups of articles suspended on the respective brackets.

8 Claims, 3 Drawing Figures

MERCHANDISE DISPLAY RACK

FIELD OF THE INVENTION

This invention relates, in general, to racks utilized in retail stores for display of packaged articles of merchandise in vertically spaced groups. It relates more particularly to a display rack adapted to be secured to a vertical support wall and having a plurality of horizontally extending arms on which the articles of merchandise are suspended in overlapped vertically displaced tiers in a reverse waterfall arrangement.

BACKGROUND OF THE INVENTION

Display of packaged articles of merchandise or other similar types of merchandise designed to be suspended from support arms has heretofore generally employed the basic concept of each article occupying a vertical display board area equivalent to the actual projected plan area size of the packaged article or the article itself in those cases where packaging is not used. Each article or a group of the same articles are frequently merely suspended from wire rod support arms that are designed to be detachably engaged with a peg board type of vertical support panel. The support arms are designed to engage with different types of packages or articles and they are generally of a single or double wire rod type. A display of this type has particular advantage in that it enables the retailer to rearrange the display and to adjust it for accommodating the specific articles which he desired to display. A significant disadvantage of a display of this type is that it very frequently is an uneconomical use of the display area which is of great concern to a retain merchant.

This wasted space or area for display of numerous articles is readily appreciated in the case of display of a number of the same type of articles, but wherein the articles will have different visual decorations that distinguish respective articles. While the articles are of the same type and thus the information concerning the article is essentially the same on all the packaging, prior merchandising practices have required that the entire article continue to be visible if it is desired to also exhibit the different types of ornamentation or decoration that may be applied to each articles, or configuration of the articles. Such a situation is particularly prevalent in the case of articles such as splash guards in the automotive accessories retail field. The upper portion of splash guards for vehicles are invariably of the same construction and are only of mechanical significance. It is the lower portions of the splash guards that are of interest from a retailing standpoint as it is the lower portions to which decoration is applied. That decoration may be in the form of various colored designs or the particular vehicle name with which the splash guard is to be used. Packaging for such splash guards usually comprises a flat cardboard type package to which the splash guards are either physically attached or secured by blister packing and these cards are uniquely adapted to be suspended at their upper portions. It is a frequent technique to apply the descriptive material to an upper portion of the packaging since that is the portion which may cover or partially hide the upper portion of the guards relating to only the mechanical functioning components and the lower portions are then left fully exposed for viewing the specific decoration. It can be readily seen that with a display wherein each type of splash guard occupies area equal to its own size that there is a large amount of repetition of the same descriptive material, and thus, a waste of display space as to the portions of the packages which relate only to the repetitive descriptive material.

SUMMARY OF THE INVENTION

A display rack of unique and novel design is provided by this invention having the specific function of reducing the surface area required for display of flat packaged type articles in suspended groups on a vertical wall. A display rack of this invention such as the illustrative embodiment comprises a fabricated wire rod structure that is designed to support a plurality of packaged articles in respective vertically displaced tiers with each of these tiers being in an overlapped relationship along a vertical axis. The rack includes a support standard having a support element that extends upwardly and in a forwardly inclined direction with respect to a support or mounting wall such that the articles will be suspended in what is termed a reverse waterfall arrangement. The support standard includes a base frame which is adapted to provide lateral stability to the standard and to facilitate the detachable mounting of the rack on a peg board type of display wall panel.

In this illustrative embodiment of the invention, the rack includes a plurality of support brackets that are mounted in fixed relationship on the inclined support element of this standard with each of these brackets being spaced from the other in vertically spaced relationship. Each of the brackets if of an L-shape having a horizontal leg that projects a distance forwardly in a substantially horizontal plane and on which the several articles of merchandise are suspended. Each of the brackets includes a vertically extending leg portion which not only enables attachment of the bracket to the inclined support element as by welding, but positions the rearward end of the horizontal leg a distance below the forward edge of the support element such that the horizontal leg may be completely filled with the articles as there will be sufficient space at the end to accommodate the vertical extent of the header portions of such articles of merchandise. The forward inclination of the support element and the horizontal length of the support bracket legs are designed such that the respective brackets will not project into the supporting area of the next above support bracket. By appropriate diminsioning, the display rack may thus be constructed so that the vertical spacing occupied by a multiple tiered group of articles will be substantially less than the actual total length of the cumulative length of the articles, and thus, result in a substantial reduction in the vertical space required for display of the articles. With the reverse waterfall arrangement, the bottom portions of the articles remain exposed for viewing by the prospective customers even though the upper portions of the succeeding lower tiers are disposed rearwardly of the forwardmost groups of the articles and are thus concealed, but the articles on the uppermost tier are completely exposed so as to present the descriptive information.

These and other objects and advantages of this invention will be readily apparent from the following detailed description of an illustrative embodiment thereof and the accompanying drawings.

DESCRIPTION OF THE DRAWING FIGURES

DESCRIPTION OF THE ILLUSTRATIVE EMBODIMENT

Figure 1:
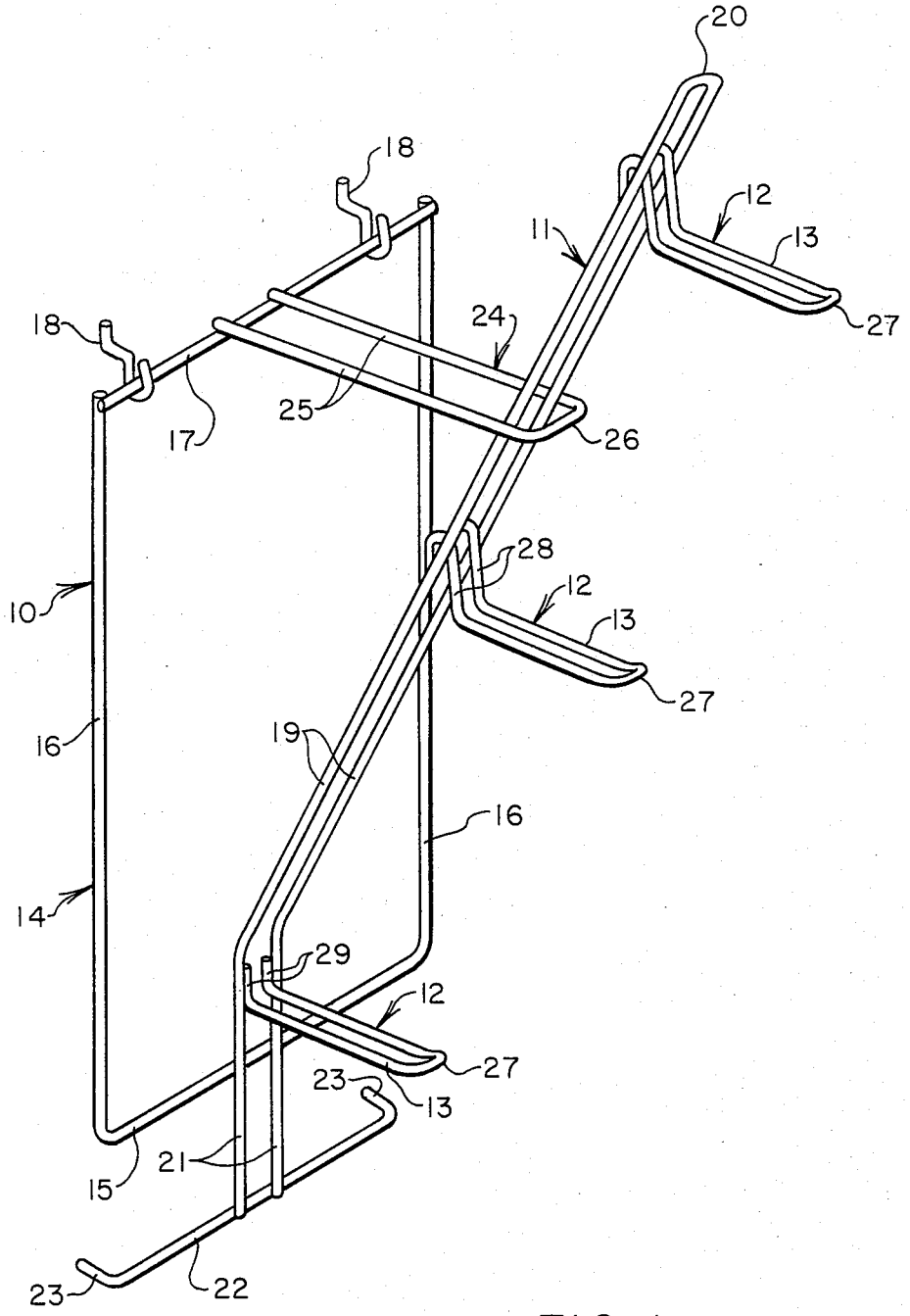
FIG. 1 is a perspective view of a display rack embodying this invention.

Referring to the drawing figures, it will be seen that the display rack embodying this invention is shown as it would be positioned when mounted on a vertically disposed supporting panel or board. The supporting panel or board is not shown, but it is understood that such a board for the illustrated rack would be of the peg board type which cooperates with wire rod type hooks for readily enabling devices to be attached or removed from the board.

The display rack includes a support standard 10 which has a support element 11. Mounted on the support element 11 are a plurality of support brackets 12 which are each provided with a generally horizontally disposed leg 13 which projects forwardly and on which the articles of merchandise are to be suspended.

The support standard 10, as are all of the elements and components of the display rack, is formed from a steel wire rod that is particularly adapted to welded fabrication. The standard includes a base frame 14 which is of a generally rectangular shape formed by a U-shaped rod with a bottom cross bar 15 and spaced apart vertically extending side rods 16 interconnected at their top ends by a cross bar 17. Attached to the top cross bar 17 are a pair of hooks 18 designed for interconnecting with a peg board to secure the structure to the board. These hooks 18 are pivotally connected to the cross bar and are positioned at respective sides adjacent a vertical side rod 16 to coincide with the peg board hole spacing.

Forming the support element 11 are a pair of elongated rods 19 extending in spaced parallel relationship to each other with the support brackets 12 being welded to each of the rods in fixed relationship. The support element 11 may be formed from a single length of wire rod which is bent into a small radius, U-shaped end 20 which is adapted to form the upper end of the support element and thus offers the advantage of a rounded end not only for appearance, but for purposes of safety. The length of the rods 19 are substantially greater than the vertical height of the base frame 14 and has its lower end portion bent to thereby result in the support element having a vertically extending lower section 21 and an upper section that is relatively inclined in a forward direction with respect to a vertical plane. The lower section 21 is secured as by welding to the bottom cross bar 15 and has end portions thereof extending a distance below that cross bar. Secured to the extreme bottom ends of the lower section 21 is a horizontally extending transverse bar 22. The transverse bar 22 extends a substantially equal distance to each side of the respective lower sections 21 and terminates in a short leg 23 that extends rearwardly. These legs 23 are spaced apart a distance to enable them to project into respective holes in a peg board. The transverse bar provides not only additional lateral stability to the entire unit, but it provides substantially the entire vertical support for the structure.

For further structural rigidity and strength, the upper end portion of the support element 11 is rigidly connected to the top cross bar 17 of the base frame. Providing this rigid connection is a connector 24. This connector 24 is formed from an elongated rod bent into a U-shaped configuration and has side legs 25 which are spaced apart a distance substantially equal to the spacing of the rods 19 of the support element which passes between those legs. The free ends of the side legs 25 are securely welded to the top cross bar 17 while the opposite ends being integrally interconnected by a cross bar 26 and thus presents a safe end projecting toward the front of the display rack. It will be noted in the drawings that the rods 19 do not rest on the cross bar 26 of the connector 24, but are welded to the respective side legs 25 a short distance rearwardly of the cross bar. This specific construction is primarily dictated by wire rod welding techniques and not by structural considerations.

Secured to the support element 11 are the three support brackets 12. These support brackets are spaced along the support element with the lowermost bracket being secured to the vertically extending lower section 21 of the rods 19. The upper two are uniformly spaced with the top one being positioned adjacent to the uppermost U-shaped end 20. The basic structure of each of the support brackets 12 is substantially the same, although the lowermost bracket differs in the portions thereof that function to mechanically interconnect with the support element. Thus, each of the brackets 12 includes an elongated wire rod bent into a U-shape having two spaced parallel side legs interconnected at their forward or leading ends by an integral U-shaped end 27 and which forms the horizontal leg 13. Thus, each of the support brackets 12 has a pair of elongated wire rods disposed in a substantially horizontal plane and defining a supporting surface. Preferably, the U-shaped end 27 at the leading ends of each bracket is turned slightly upward to prevent articles from inadvertently sliding off of the respective brackets.

Also, the horizontal legs 13 are preferably inclined upwardly from their rearmost ends at an angle of 3–5 degrees with respect to the horizontal so that the articles suspended therefrom will tend to garvitate toward the rear of the bracket, thereby better assuring that the articles will not fall off of the rack. The rear end portions of each of the two uppermost brackets are bent upwardly and the end portions then formed into vertical legs 28 of an inverted U-shaped configurations. The vertical legs 28 project between the rods 19 and each element of leg is secured to a respective rod 19 by welding. It will be noted that the horizontal legs 13 are thus connected to the rods 19 by a vertically extending section which forms a back stop for the articles that are supported on the respective bracket. The vertical spacing between the horizontal legs 13 and the rod 19 is preferably of the order of the vertical extent of the type of merchandise that is to be supported on the rack. The lowermost bracket 12 terminates in respective upwardly extending vertical leg 29 which has the two elements thereof welded to the respective vertical lower sections 21. It will be noted that the lowermost bracket is secured to the element 11 at a point spaced below the bend in the rods 19 such that there will also be the desired vertical extent forming a back stop for the articles of merchandise placed on that bracket.

This display rack, as indicated, is fabricated from wire rods which are welded together to form a rigid unit except for the hooks 18 adapted to engage with the peg board. For a finished appearance, the wire rods may either be plated with a suitable metallic material or they may be covered with a protective plastic sheathing.

Figure 2:
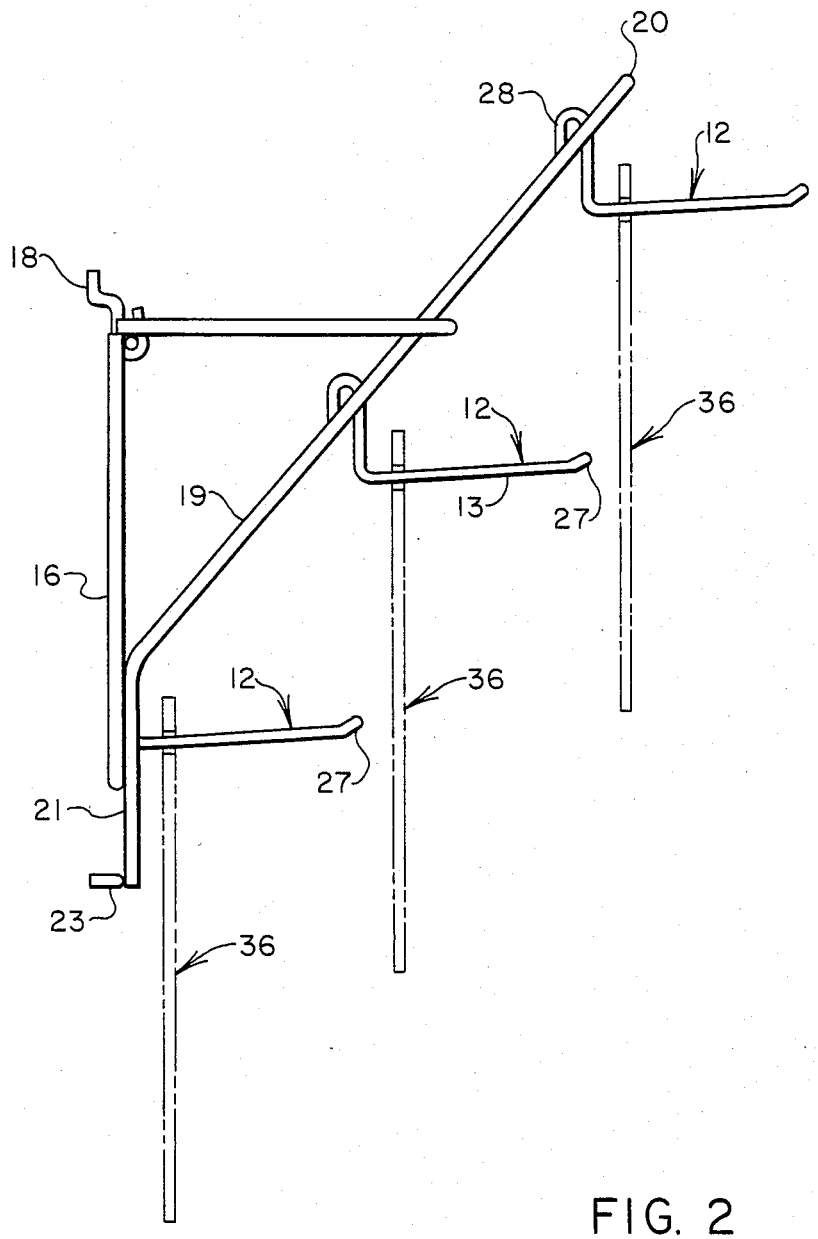
FIG. 2 is a side elevational view thereof illustrating articles of merchandise suspended on the rack.
Figure 3:
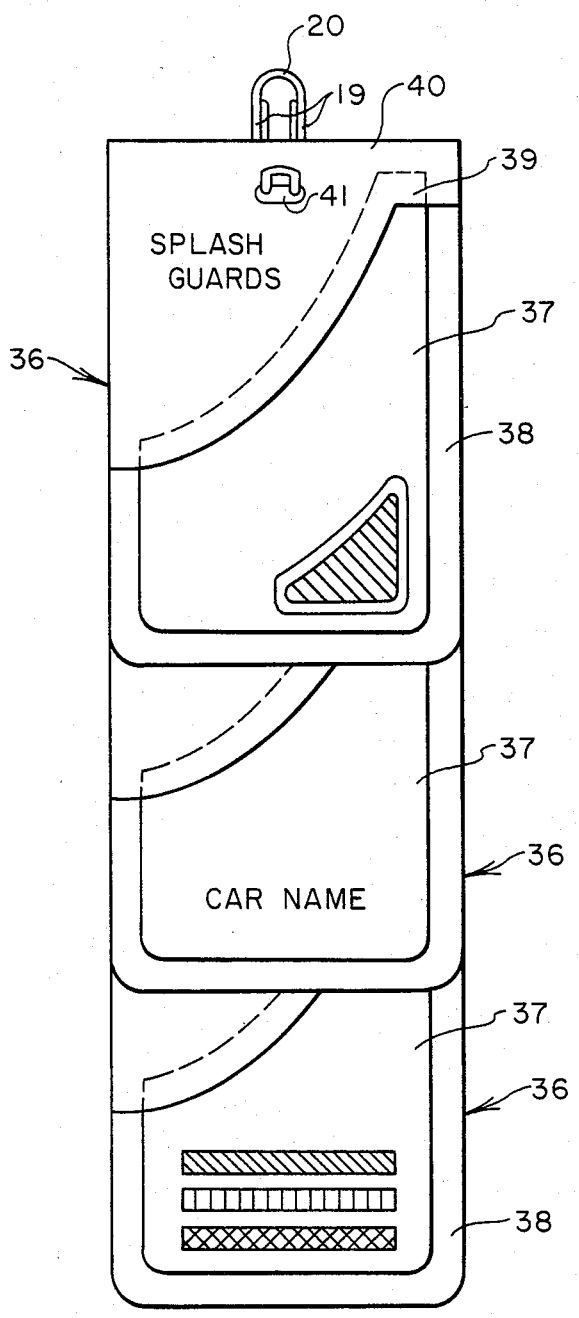
FIG. 3 is a front elevational view of the rack with articles of merchandise suspended on the rack.

The merchandise display rack of this invention is particularly designed for use with articles of merchandise which are packaged on flat cards and adapted to be suspended in a vertical position. Illustrative of such merchandise are the splash guards that are sold for attachment to automotive vehicles. These splash guards are very frequently packaged in cardboard devices which are of a unitary construction including a rear sheet-form element and at least a partial sheet-form front element joined at a transverse fold line and combining to form an upper header portion by which the article may be suspended from a suitable support. Such articles of merchandise are shown for purposes of illustration in FIGS. 2 and 3 to demonstrate the advantageous utility of this display rack. Referring to FIGS. 2 and 3, it will thus be seen that a typical article of merchandise 35 of this type and particularly adapted for use with this display rack includes a packaging card 36 containing the specific article which is illustrated as an automative splash guard 37. The packaging card 36 includes a rear sheet form element 38 and a front sheet form element 39 that are folded over about a transverse fold line 40 into superposed, parallel relationship. The splash guard 37 is positioned against the rear element 38 and has its upper edge portions projecting between the superposed front element 39 and the rear element. Thus, the upper portion of the card elements projecting above the splash guard from a header section 41 which is provided with an aperture 42 of elongated slot-form for receiving a supporting element such as the support brackets 12 of this display rack.

The splash guards 37 are of a construction which usually includes a decorative design or imprinted vehicle name at the bottom end portion. Thus, it is important that the bottom ends of the splash guards be exposed or visually observable so that is the part which prospective buyers or customers inspect to determine which, if any, of the splash guards they desire to purchase. FIG. 3 illustrates three different types of conventional ornamentations that are applied to splash guards of this type to better demonstrate the purposes that are achieved by this display rack. The front sheet form element 39 also is provided with printed information relative to the splash guards. Since that information is essentially the same as for any of the splash guards, it is only necessary that one such card is visible at the upper portion for examination by the prospective purchasers.

Splash guards for vehicles are generally manufactured in either of standard vertical heights that are not significantly different being in the order of two 12–16 inches, and thus, either size will fit on a same sized rack. This illustrative display rack is specifically dimensioned to accommodate three tiers of such articles of merchandise of this vertical dimension in a vertically spaced arrangement. The dimensioning of the components of the rack are such that the support brackets 12 will be vertically spaced so that the lower portions of the splash guards that are on rearwardly disposed brackets will have the lower portions fully exposed. This dimensioning is of the order that the brackets are spaced vertically about one half the vertical extent of the splash guards or their packaging. Also, looking at FIG. 2, it will be seen that the horizontal extent of the brackets is such that they will not extend a distance forwardly to project into the hanging space of the next above bracket. The horizontal extent of the brackets 12 is a function of the inclination of the support element 11 with the brackets capable of having a greater horizontal extent, and thus, capability to receive a larger number of articles of merchandise where the support element is inclined at a lesser angle with respect to the horizontal as compared to a greater angle than that which is illustrated. This angle of inclination of the support element also bears some relationship to the vertical length of the articles that may be accommodated on the rack, although this factor is not of a great significance as the horizontal extent of the brackets. While a specific example is shown and described as to the rack and the merchandise to be supported thereon, it will be understood that such use and proportional dimensioning is not limitative as to construction of racks of other dimensions or in the forming of specific components, thereof, such as for one example, providing bracket 12 having only one single wire rod.

It will be readily apparent from the foregoing description of the illustrative embodiment of the display rack of this invention that such a rack provides substantial improvement over other display racks for merchandise articles of this type. This reverse waterfall arrangement of several support brackets enables the display rack of this invention to provide the necessary visual display of a greater number of articles for a specified vertical surface area such as a peg board display panel. Also, display of the articles in this manner does not seriously impede the removal of a selected article even though such an article may be carried on a bracket which is rearward of at least one other tier of articles. The customer can readily reach sideways behind one group of articles to select an article and remove it from its supporting bracket. The rack is also of a very stable construction as a consequence of the relatively wide base frame and is rigidly secured to a vertical peg board panel by the respective hooks and legs formed on or with the components.

Having thus described this invention, what is claimed is:

1. A merchandise display rack for vertically suspending articles of predetermined vertical extent from their upper end portions in a plurality of vertically displaced tiers comprising a support standard having means for cooperatively engaging with base support means to maintain said standard in an upright position, including a vertically disposed planar base frame adapted to be positioned against a vertical support surface of base support means for thereby stabilizing said support standard, said support standard having a support element projecting upwardly from a bottom end portion in forwardly inclined relationship toward the direction of viewing of merchandise carried in the rack, and a plurality of merchandise support brackets mounted on said support element in relatively spaced relationship to support articles of merchandise in a plurality of vertically displaced tiers, each of said brackets including a leg for suspension of articles therefrom disposed substantially horizontal in forwardly projecting relationship to said support element and adapted to cooperatively engage with articles in suspension of the articles therefrom, each of said brackets being vertically spaced relative to a next adjacent bracket a distance less than the vertical height of the articles suspened therefrom whereby lowermost portions of articles suspended from one bracket will depend in front of the next lower bracket leg in overlapping relationship to upper portions of articles suspended from said next lower bracket, but which vertical spacing of next adjacent brackets leaves a bottom portion of articles on the next lower bracket exposed to visual observation from the front of the display rack.

2. A display rack according to claim 1 wherein said support element has a leading edge and each of said support brackets is secured to said support element to position the horizontal leg thereof such that the rearward end of each horizontal leg is spaced vertically below the support element leading edge a distance at least as great as the distance that an article of merchandise extends above a horizontal leg.

3. A display rack according to claim 1 wherein each of said support bracket legs does not extend further forward than a vertical plane extending through the rearward end of the next above support bracket leg.

4. A display rack according to claim 1 wherein said support standard includes means for cooperatively interengaging in holes of a peg board for mechanically securing of the rack thereto.

5. A merchandise display rack for vertically suspending articles of predetermined vertical extent from their upper end portions in a plurality of vertically displaced tiers comprising a support standard having means for cooperatively engaging with base support means to maintain said standard in an upright position including a base frame formed at elongated, rod-shaped elements arranged in a closed loop configuration defining a plane of predetermined vertical and horizontal extent and having upper and lower horizontally extending elements lying in said plane to provide lateral stability, said support standard having a support element projecting upwardly from a bottom end portion forwardly inclined relationship toward the direction of viewing of merchandise carried on the rack, said support element being formed from an elongated, rod-shaped element disposed in a vertical plane which is substantially perpendicular to the plane of said base frame and is secured at its lower end to the lower horizontally extending element of said base frame, and a plurality of merchandise support brackets mounted on said support element in relatively spaced relationship to support articles of merchandise in a plurality of vertically displaced tiers, each of said brackets including a leg for suspension of articles therefrom disposed substantially horizontal in forwardly projecting relationship to said support element and adapted to cooperatively engage with articles in suspension of the articles therefrom, each of said brackets being vertically spaced relative to a next adjacent bracket a distance less than the vertical height of the articles suspended therefrom whereby lowermost portions of articles suspended from one bracket will depend in front of the next lower bracket leg in overlapping relationship to upper portions of articles suspended from said next lower bracket, but which vertical spacing of next adjacent brackets leaves a bottom portion of articles on the next lower bracket exposed to visual observation from the front of the display rack.

6. A display rack according to claim 5 wherein said base frame includes a connector disposed at the upper end of said base frame and secured to the upper horizontally extending element of said base frame and said support element for providing a rigid interconnection therebetween.

7. A display rack according to claim 5 wherein said support element is formed with the rod-shaped element disposed in two spaced parallel sections and each of said brackets is formed from an elongated rod formed into a U-shape having the legs thereof disposed in a substantially horizontal plane and secured to respective ones of the sections of said support element.

8. A display rack according to claim 5 wherein said support element extends a distance below said lower horizontal element of said base frame and said support standard includes an elongated, transverse bar secured to said support element in spaced below relationship to said lower horizontal element, said transverse bar having a leg formed at each end thereof and extending in rearwardly projecting relationship to the plane of said base frame and adapted to interengage with a peg board.

* * * * *